US006205947B1

(12) United States Patent
Drew

(10) Patent No.: US 6,205,947 B1
(45) Date of Patent: Mar. 27, 2001

(54) PLACE FINDER BOOKMARK

(76) Inventor: Iris Carolyn Drew, 2347 Edgewood Blvd., Berkley, MI (US) 48072

( * ) Notice: Subject to any disclaimer, the term of this patent is extended or adjusted under 35 U.S.C. 154(b) by 0 days.

(21) Appl. No.: 09/193,450

(22) Filed: Nov. 17, 1998

Related U.S. Application Data

(60) Provisional application No. 60/065,587, filed on Nov. 18, 1997.

(51) Int. Cl.[7] ..... B42D 9/00

(52) U.S. Cl. ..... 116/235; 116/238; 281/42; D19/34

(58) Field of Search ..... 116/234–240; 281/42; D19/34

(56) References Cited

U.S. PATENT DOCUMENTS

| | | | | |
|---|---|---|---|---|
| 727,572 | * | 5/1903 | Bauer | 116/234 |
| 759,427 | * | 5/1904 | Fairchild | 116/235 |
| 1,008,481 | * | 11/1911 | Lopes | 116/235 |
| 1,872,807 | * | 8/1932 | Posner | 116/234 |
| 1,966,340 | * | 7/1934 | Forbringer et al. | 116/235 |
| 2,282,939 | * | 5/1942 | Clawson | 116/234 |
| 2,591,094 | * | 4/1952 | O'Neill | 116/234 |
| 2,630,777 | * | 3/1953 | Johnson | 116/235 |
| 2,964,010 | * | 12/1960 | Harrison | 116/234 |
| 4,901,665 | * | 2/1990 | Carlin | 116/235 |
| 5,081,948 | * | 1/1992 | Walsh | 116/240 |
| 5,437,240 | | 8/1995 | Miroyan | 116/235 |
| 5,462,006 | * | 10/1995 | Thiruppathi | 116/234 |
| 5,515,809 | | 5/1996 | Weinberg | 116/235 |
| 5,577,459 | | 11/1996 | Alden | 116/234 |
| 5,632,225 | * | 5/1997 | Krasner | 116/235 |

FOREIGN PATENT DOCUMENTS

| | | | | |
|---|---|---|---|---|
| 007623 A5 | * | 10/1988 | (CH) | 116/234 |
| 4125234 A1 | * | 2/1993 | (DE) | 116/239 |
| 2275018 | * | 8/1994 | (GB) | 116/238 |

* cited by examiner

*Primary Examiner*—Diego Gutierrez
*Assistant Examiner*—Stanley J. Pruchnic, Jr.

(57) ABSTRACT

A place finder bookmark for identifying a reader's position on a book page. The inventive device includes a two-way slide (placefinder) on a strip (page-finder). The slide further includes a first set of parallel, horizontal slots for sliding up and down on the strip to locate the vertical position. A right/left slidable bar, inserted through a second set of parallel, vertical slots, can move side to side in a horizontal direction within the slide to show an arrowhead pointing to the right or left hand page. A flat durable anchor member is attached to one end of the strip to hold the placefinder bookmark in position.

8 Claims, 3 Drawing Sheets

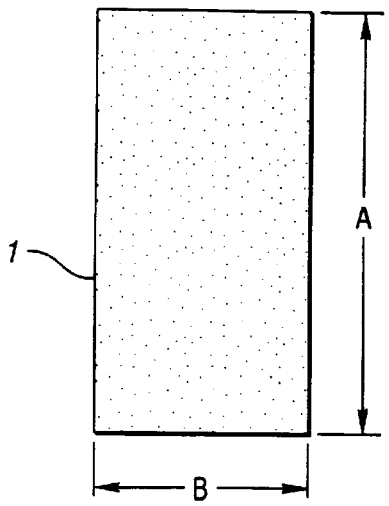
Fig. 6
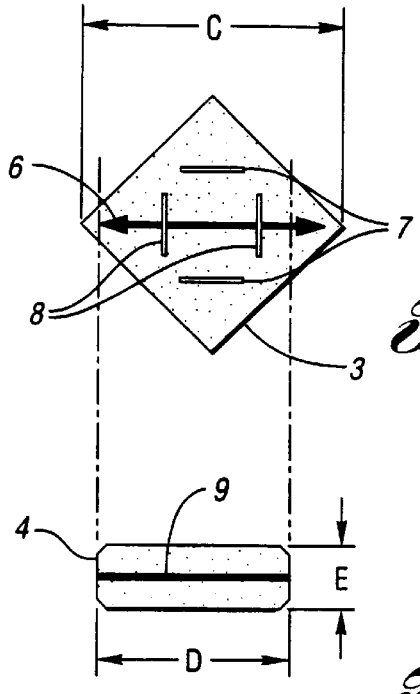
Fig. 7
Fig. 8
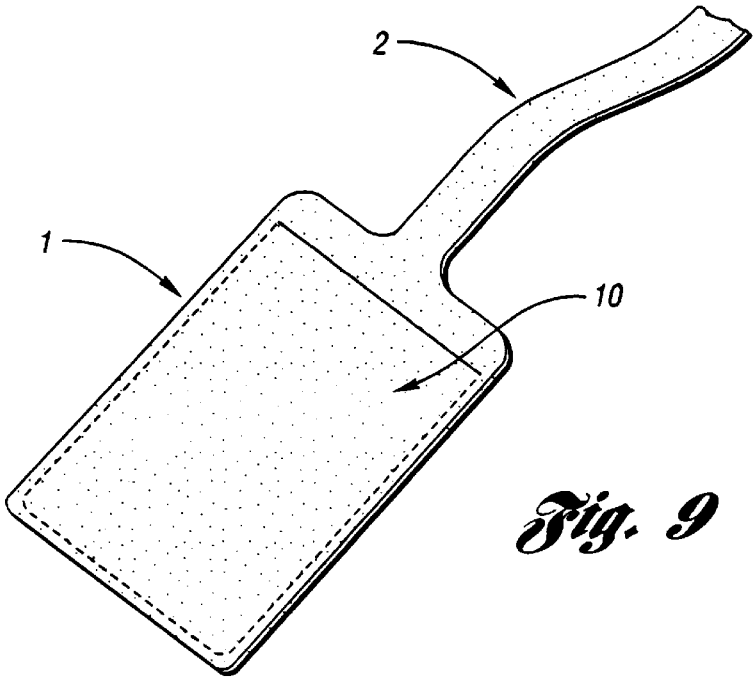
Fig. 9

PLACE FINDER BOOKMARK

This application claims benefit of Provisional No. 60/065,587 filed Nov. 18, 1997.

BACKGROUND OF THE INVENTION

1. Field of the Invention

The present invention relates to a bookmark for assisting the reader in finding the last page of reading in the book and more particularly the exact paragraph and line on the right or left hand page where the reader last finished reading.

Conventional bookmarks typically mark or identify pages of interest or place of last reading in a book. A great number of bookmark constructions have been suggested in the prior art. The simplest are elongated cards, strings, or slips of paper. They do not provide any information to identify a particular page or location on that page. Consequently, readers can forget where they left off in their reading. Additionally, these bookmarks are not anchored and can easily fall out from between the pages.

2. Description of the Related Art

Some bookmark constructions employ a type of line indicator element which is movable along the length of the bookmark for use in locating a particular line of print on a selected page of the book. One type is taught in U.S. Pat. No. 5,577,459 to Alden wherein the bookmark utilizes an imprinted encircling indicator band or collar that slides vertically about the body of an imprinted paper board or plastic strip. The collar is characterized by a centrally located punched out aperture that serves as a framing device to highlight the indicia imprinted on the body of the bookmark specifying the page and number of the last paragraph read.

Another type is taught by U.S. Pat. No. 5,437,240 issued to Miroyan disclosing a bookmark for marking a page and line in a book. The bookmark includes an elongated planar body and finger engaging indicator piece that is slidably movable along a slit provided in the body from a first position overlying the design element to a second line marking position.

U.S. Pat. No. 5,515,809 to Weinberg discloses a bookmark including a head member with removable adhesive for attaching the bookmark to the spine of the book. The tail member is draped over the top of the book and positioned between two selected pages. A removable adhesive dot disposed on the tail member allows it to be removably attached to one of the pages, thereby marking a specific piece of information on the page for the reader.

Another prior art construction disclosed in U.S. Pat. No. 4,901,665 issued to Carlin includes a slidable indicator element that is provided with index means viewable from both sides of the body for alignment with the line of interest.

A slight variation in the theme is disclosed in U.S. Pat. No. 2,630,777 issued to Johnson. The bookmark of this patent comprises a body portion with parallel slits which define tracks along which a line indicator element travels. The indicator element comprises oppositely extending pointers that override the tracks.

These and all other prior art bookmarks are either prone to falling out of a book, or cannot indicate which of the two pages they mark contains the information of interest. Those that can indicate specific lines may be unable to mark the page because they are sometimes hidden when the book is closed. Bookmarks comprising simple cards or strips can only mark one page at a time, can easily be separated from the book they are used to mark, and can easily be misplaced. Bookmarks having semi-rigid strips with attached flexible cords can not be used on paperback books unless they are used in a fashion similar to simple cards or strips in which case they can also be easily misplaced. Plus, all the prior art, for the most part is complex and/or bulky or cumbersome by design and is not practical for the casual reader.

Consequently, a need exists for a bookmark which avoids the disadvantages of prior art bookmarks. The present invention provides an improved bookmark designed to satisfy that need. The bookmark of the present invention is of a substantially simpler construction than those of the prior art. The advantages of the present invention provide an improved bookmark, a bookmark which can be securely anchored to a book, which can mark a specific page of interest, and can mark a specific line of interest or piece of information

BRIEF SUMMARY OF THE INVENTION

It is the object of the present invention to provide an improved bookmark which can be securely anchored to a book and can removably mark a specific page of interest and mark a specific line of interest on that page, while being simplicitic in form and function, as well as inexpensive.

Another object of the invention is to mark a specific page and line of interest, and also to be easily and repeatedly repositioned for marking another page. It is a further objective to provide an article of manufacture that by its simplistic nature will be easy to manipulate and handle and can be easily removed for use in book after book. It can be desirable when used in multiples, as in text books and reference manuals for study and research, ie; legal research in case law citations.

The aforementioned objects are achieved by the bookmark of the present invention, which comprises a two-way slide (placefinder) on a strip (pagefinder), and a flat durable anchor member attached at one end of said strip to hold the strip in place. The slide (placefinder) further includes a horizontal slot which provides a means for sliding up and down on the strip in the vertical direction and an additional vertical slot with a right/left lined bar as part of a means to reveal an arrowhead on the slide pointing to the right or left hand page.

BRIEF DESCRIPTION OF THE DRAWINGS

FIG. 6 displays the anchor (1) for retaining the placefinder bookmark in place within the book. Dimensions A & B may vary as required by individual design intention, but will commonly be rectangular in a preferred embodiment, but could be of any shape.

FIG. 7 shows the placefinder slide (3) with two pair of slots, vertical and horizontal. Dimension C is equal to or greater than dimension B (FIG. 6), but not more than 10% greater to obtain the best fit in the book. The double arrow imprint (6) is less than dimension C as shown. The horizontal slots (7) should be slightly greater than the width of the strip (2) for ease of movement. The vertical slots (8) should be slightly greater than the right/left bar (4) height for ease of movement (Dim E, FIG. 8).

FIG. 8 shows the right/left bar (4). The width of the right/left bar (4) is such that only one arrowhead of the arrowhead imprint (6) is revealed at a time. When moved to the right, the left arrowhead is shown; and when moved to the left, the right arrowhead is shown. Dimension E is designed such that the bar (4) fits easily into the vertical slots (8) of the slide (3) as shown in FIG. 7. The imprinted line (9) located at the center of the width E of the bar (4) should match the arrowhead imprint (6) on the slide (3) of FIG. 7 and be the same color and line weight.

FIG. 9 shows a one-piece member formed from the combination of anchor member 1 and strip member 2 into a single member.

DETAILED DESCRIPTION OF THE INVENTION

Figure 1:
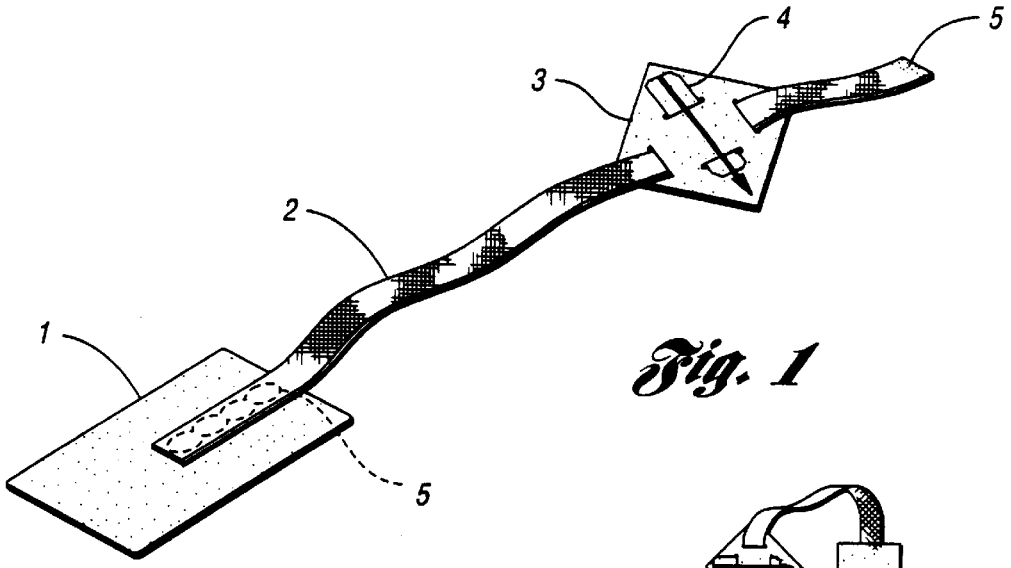
FIG. 1 shows the essential elements of the present invention, namely the anchor and adhesive joining medium (1), the strip (pagefinder) (2), the slide (Placefinder) (3), imprinted with a double arrow head (6) and further including a line imprinted right/left bar (4).

The preferred embodiment of the Place Finder Bookmark Invention comprises a two-way slide (placefinder) 3 with slotted means for engaging a ribbon-type strip (pagefinder) 2 as in FIG. 1. The strip can be a ribbon or other flexible material which is fairly smooth and of variable length and width. Ideally the strip 2 must be long enough to span the height of an average book plus some additional length for affixing the anchor 1 in as FIG. 2. The strip 2 should be narrow enough to pass through the slots in the two-way slide (placefinder) 3 as in FIG. 1.

Figure 4:
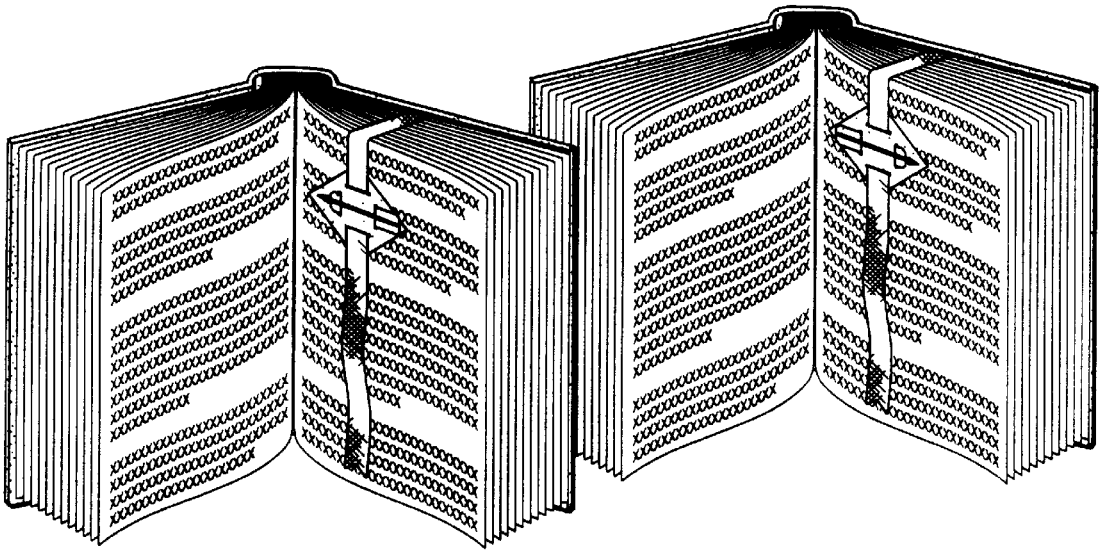
FIG. 4 shows the right/left bar (4) in the two positions for marking a right hand or left hand page where the reader completed his last reading. The right/left bar (4) is pushed to the left to display a right pointing arrow and to the right for left pointing arrow of the imprinted arrow head (6) on the slide (3).
Figure 5:
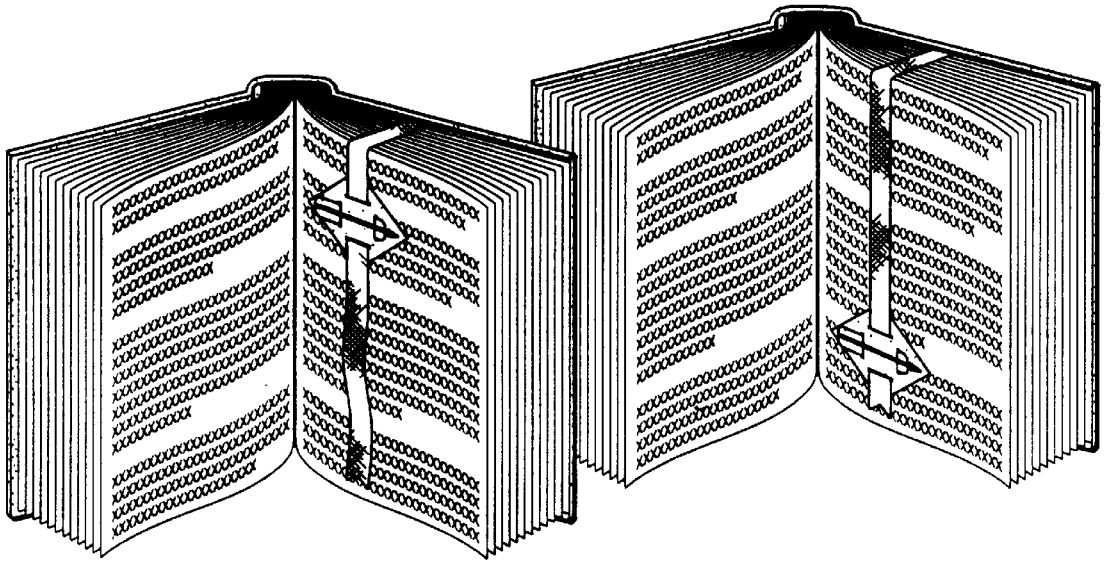
FIG. 5 depicts the slide (placefinder) (3) in both top and bottom vertical positions on the strip (2) for marking the reader's position upon a particular page. The slide is moved up or down to indicate the line of the paragraph to begin reading next.

The two-way slide (placefinder) 3 is a slotted member which can be positioned up and down on the strip 2 to locate a vertical position on a book page FIG. 5. The slide 3 further includes a first and second set of parallel, horizontal slots 7 for vertical engagement on the strip 2 and a second set of parallel, vertical slots 8 for horizontal engagement of the right/left bar 4, shown in FIG. 8. The right/left bar 4 (page locator) is inserted through the second set of slots 8 and can be moved from side to side within the slide 3 to display an arrowhead 6 pointing to right or left hand page as illustrated in FIGS. 4 and 5.

Figure 2:
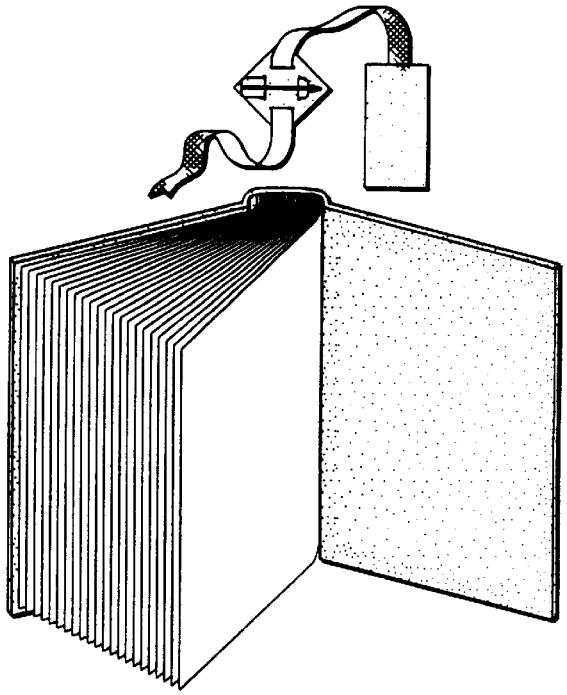
FIG. 2 represents a preferred embodiment of the present invention, wherein the anchor member (1) is frictionally mounted inside the back of the book The anchor (1) is placed at the back of the book for the entire reading and typically left in place.
Figure 3:
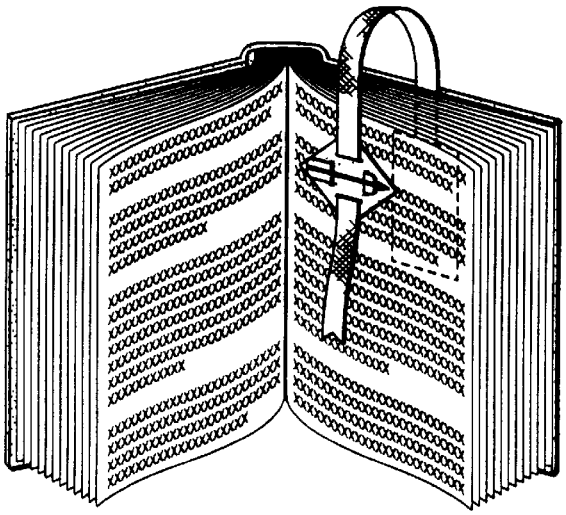
FIG. 3 illustrates the strip (2) being placed in a book at the reading page. The strip (2) is placed on a page when not reading. When reading, the strip is typically allowed to hang behind the cover, outside the book.

The strip (pagefinder) 2 further comprises an anchor member 1 (FIG. 6) at one end of the strip 2 to hold the strip 2 in place as in FIGS. 1 & 2. Ideally in the preferred embodiment, the anchor member 1 is of the size of a typical rectangular business card and is held in place by frictional attachment means within the book pages as shown in FIG. 3. The anchor 1 is secured to the strip 2 with securing means 5 as shown in FIG. 1.

In the preferred embodiment, the strip 2 is of ribbon stock narrow enough to go through slots 7 in the slide and wide enough to lay flat. The strip could also be of string or other connecting means. The strip 2 must be long enough to span the height of an average book plus additional length to attach the anchor member 1.

The anchor 1 for the strip 2 should be large enough to provide the friction necessary to remain in place but smaller than the book page. Ideally, it should be approximately the size of a business card.

The slide 3 in the preferred embodiment, further includes a grouping of two horizontal and two vertical parallel slots 7 & 8. The two horizontal slots 7 engage the strip 2 and will, when so engaged, allow it to slide up and down on the strip 2 to stay where desired to indicate a line (or height) on a page by its position on the strip 2 relative to the text. The two vertical slots 8 engage the right/left bar. When so engaged, the right/left bar 4 can be moved to the right or to the left through these slots 8 to expose, or hide one or the other of the two arrowheads 6 on the slide 3, thereby indicating whether the reading place is on the right or left hand page. The slide 3 ideally is square in shape and aligned on the diagonal axis for both vertical and horizontal engagement with the strip 2 and said right/left bar 4. The slide 3 could be any of several shapes; however, the square shape best lends itself to the purpose and function of the bookmark. The imprinted line (9) located at the center of the width E of the bar (4) should match the arrowhead imprint (6) on the slide (3) of FIG. 7 and be of the same color and line weight.

The securing means 5 for joining the strip 2 to the anchor 1 could be tape, glue, other adhesive bonding agent.

In another embodiment of the Place Finder Bookmark (FIG. 9), the anchor 1 and the strip 2 elements of the invention are combined into a single one-piece integral member of the same material, conceivably a soft, flexible plastic or nylon. The material could be die cut or otherwise formed into the the shape of the anchor member 1 and the strip member 2 combined into a single one-piece member. Additionally, the combined integral one-piece member could be of a clear, transparent material, opaque and of variable color. The anchor member 1 may include a pocket 10 for inserting another item of the owner's discretion (ie. photo, greeting, identiification, business card, logo, or others).

The reader, upon ending a reading session, will want to be able to relocate his/her place in the reading material (book) for the next reading session. The bookmark FIG. 1 of this invention performs this function. To begin, the reader places the anchor 1 of the invention at the back of the book in such a way that the anchor lodges with frictional attachment means in the pages near the spine of the book and will stay there until the bookmark invention is intentionally removed to be placed in another book. The anchor 1 is placed in such a way that the strip 2 extends out of the book at the top.

After a reading session, the reader will place the strip 2 between the pages at the place in the book where reading ended. The slide will be removed up or down on the strip 2 to the vertical position of last reading. The right/left bar 4 will be removed to the right or to the left so that an arrowhead 6 is visible thus indicating whether the desired place to continue reading is on the right hand page or the left hand page. When the book is closed, the place setting will remain unchanged between the pages. When the book is reopened for the next reading session, the exact place to begin can be easily located. The strip 2 and slide 3 assembly can be conveniently allowed to hang over the cover (outside the book) during reading, thereby remaining readily available for next use.

I claim:

1. A placefinder bookmark for identifying a reader's position on a page of a book comprising:

(a) a strip pagefinder for locating pages within a book;

(b) a two-way slide placefinder moveably disposed on said strip pagefinder for locating vertical positions on the pages of the book;

(c) said slide further includes a first set of parallel, horizontal slots for locating the slide in the vertical position on the strip pagefinder;

(d) a right/left bar, inserted through a second set of parallel, vertical slots disposed to move in the horizontal direction within the slide, to display an arrowhead pointing to the right-hand or left-hand page of the book;

(e) a double arrowhead line imprint oriented in a horizontal position on the slide and spanning a distance less than the width of the slide and further positioned mid-way between the horizontal slots; and (f) a flat anchor member with attachment means at a one end of the strip pagefinder to hold the placefinder bookmark in position within the book.

2. The placefinder bookmark as recited in claim 1 wherein the strip is comprised of ribbon stock having a width less than the horizontal width of the parallel, horizontal slots in the slide and the strip is longer than the maximum page length of the book for extended slide engagement on the ribbon to enable the reader to always find his place on the page.

3. The placefinder bookmark as recited in claim 1 wherein the anchor member located on the one end of the strip is a card having a size large enough to provide sufficient friction as the attachment means necessary to remain in place but smaller than the page of the book.

4. The placefinder bookmark as recited in claim 1 including a securing means for joining the strip to the anchor wherein the securing means is comprised of a bonding medium.

5. The placefinder bookmark as recited in claim 1 wherein the slide is aligned for both vertical engagement with the strip and horizontal engagement with the right/left bar.

6. The placefinder bookmark as recited in claim 1 wherein the anchor member and the strip pagefinder of the placefinder bookmark are formed from one-piece having a common material.

7. The placefinder bookmark of claim 1 wherein the anchor member (is provided with means for inserting a separate item such as a business card, photo, greeting, logo, or other item of the owner's discretion) includes a structure adapted to receive an inserted separate item.

8. A placefinder bookmark for identifying a reader's position on a page of a book comprising:

a strip pagefinder for locating pages within a book;

a two-way slide placefinder for locating vertical positions on the pages of the book; wherein said slide further includes a first set of parallel, horizontal slots for locating the slide in the vertical position on the strip pagefinder;

a right/left bar, inserted through a second set of parallel, vertical slots disposed to move in the horizontal direction within the slide, to display an arrowhead pointing to the right-hand or left-hand page of the book;

a double arrowhead line imprint oriented in a horizontal position on the slide and spanning a distance less than the width of the slide and further positioned mid-way between the horizontal slots; and the bookmark further comprising a flat anchor member with attachment means at a one end of the strip pagefinder to hold the placefinder bookmark in position within the book; wherein the anchor member at the one end of the strip is a card having a size large enough to provide sufficient friction as the attachment means necessary to remain in place but smaller than the page of the book; and wherein the anchor member is secured to the strip with a bonding medium; and further wherein said strip pagefinder is comprised of flexible ribbon stock having a width less than the horizontal width of the parallel horizontal slots in the slide, and said strip pagefinder is longer than the maximum page length of the book for extended slide engagement on the ribbon so as to accomodate any book size maximum page length and always enable the reader to find his place on the page; and said strip pagefinder is further adapted to be folded over the top of the page; and wherein the anchor member is further adapted to receive an inserted separate item.

* * * * *